US007827725B1

(12) United States Patent
Hagler

(10) Patent No.: US 7,827,725 B1
(45) Date of Patent: Nov. 9, 2010

(54) SCOPE ASSEMBLY

(76) Inventor: Lloyd Hagler, 3021 Balkan Dr., York, SC (US) 29745

( * ) Notice: Subject to any disclaimer, the term of this patent is extended or adjusted under 35 U.S.C. 154(b) by 759 days.

(21) Appl. No.: 11/731,993

(22) Filed: Apr. 2, 2007

(51) Int. Cl.
*F41G 1/38* (2006.01)

(52) U.S. Cl. ..... 42/127; 42/148; 359/399; 356/18; 33/334

(58) Field of Classification Search ..... 42/111, 42/124, 125, 127, 131, 148, 106; 89/37.04, 89/41.17, 41.19, 200; 356/3, 7, 8, 9, 11, 356/18; 33/333, 334; 359/399; 348/75
See application file for complete search history.

(56) References Cited

U.S. PATENT DOCUMENTS 4,561,204 A * 12/1985 Binion ..... 42/122
5,299,067 A * 3/1994 Kutz et al. ..... 359/827
5,513,440 A * 5/1996 Murg ..... 42/122
5,528,418 A * 6/1996 Bowman, Jr. ..... 359/400
5,561,555 A * 10/1996 Meier et al. ..... 359/376
5,937,562 A * 8/1999 Brough ..... 42/119
6,131,294 A * 10/2000 Jibiki ..... 42/119
6,279,259 B1 * 8/2001 Otteman ..... 42/122
6,862,832 B2 * 3/2005 Barrett ..... 42/119
6,886,287 B1 * 5/2005 Bell et al. ..... 42/120
7,350,329 B1 * 4/2008 Bell et al. ..... 42/122
7,510,340 B2 * 3/2009 Laganas et al. ..... 396/530
2008/0289239 A1 * 11/2008 Menges et al. ..... 42/125

* cited by examiner

*Primary Examiner*—Benjamin P Lee
(74) *Attorney, Agent, or Firm*—Schwartz Law Firm, P.C.

(57) ABSTRACT

A scope assembly includes an elongated viewing scope and a scope mount adapter. The viewing scope has first and second opposite ends, and at least one externally-threaded mounting post located between the opposite ends. The scope mount adapter includes a first connector having an internal screw thread mating with the external thread of the mounting post and a second connector designed for releasably engaging an accessory mounted to the scope.

9 Claims, 10 Drawing Sheets

SCOPE ASSEMBLY

TECHNICAL FIELD AND BACKGROUND OF THE INVENTION

This invention relates generally to a scope assembly, such as that commonly used on rifles, and more specifically, to a scope mount adapter designed for releasably securing an instrument accessory to the scope.

SUMMARY OF THE INVENTION

Therefore, it is an object of the invention to provide a scope assembly adapted for use on a rifle or other projectile-firing device, such as a shotgun, handgun, blowgun, bow or the like.

It is another object of the invention to provide a scope assembly which incorporates a removable scope mount adapter.

It is another object of the invention to provide a scope assembly which incorporates a quick-release instrument accessory operable for calculating and displaying information such as time, time span (e.g., stopwatch), temperature, windage, elevation, and atmospheric pressure.

It is another object of the invention to provide a scope assembly which incorporates a scope mount adapter designed for screw-attaching to an existing threaded element of the scope.

It is another object of the invention to provide a scope mount adapter designed for use on a conventional scope, such as a rifle scope.

It is another object of the invention to provide a scope mount adapter which may be constructed in multiple sizes to fit different scopes.

It is another object of the invention to provide a scope mount adapter which enables quick and convenient indexing of the instrument accessory relative to the scope.

It is another object of the invention to provide a scope mount adapter which enables quick release of the instrument accessory.

It is another object of the invention to provide a combination scope assembly, scope mount adapter, and instrument accessory.

It is another object of the invention to provide a combination rifle, scope assembly, scope mount adapter, and instrument accessory.

These and other objects of the present invention are achieved in the preferred embodiments disclosed below by providing a scope assembly comprising an elongated viewing scope and a scope mount adapter. The viewing scope has first and second opposite ends, and at least one externally-threaded mounting post located between the opposite ends. The scope mount adapter includes a first connector having an internal screw thread mating with the external thread of the mounting post, and a second connector designed for releasably engaging an accessory mounted to the scope. The scope assembly is especially applicable for use in combination with any firearm or projectile-firing device including rifles, shotguns, handguns, blowguns, paintball guns, bows, and the like. The scope assembly may also be used separately by itself.

According to one preferred embodiment of the invention, the scope mount adapter is substantially ring-shaped.

According to another preferred embodiment of the invention, a radially-extending annular divider is located between the first and second connectors of the scope mount adapter.

According to another preferred embodiment of the invention, the second connector of the scope mount adapter comprises a radially-extending annular edge spaced-apart from the divider. The annular edge cooperates with the divider to form an annular channel adapted for receiving a connecting element of the accessory. The annular channel enables rotational adjustment of the accessory relative to the scope.

Preferably, an outer surface of the scope mount adapter comprises surface texturing.

According to another preferred embodiment of the invention, the annular edge of the scope mount adapter includes circumferentially-spaced indexing points designed for selectively orienting the accessory relative to the scope.

According to another preferred embodiment of the invention, the accessory has resilient feet located between the first connector and the radially-extending annular edge of the scope mount adapter. The resilient feet define interfering structure which cooperates with the annular edge to lock the accessory onto the scope, and to enable quick release of the accessory from the scope when pinched together.

According to another preferred embodiment of the invention, the accessory comprises an instrument for displaying information such as time, temperature, windage, elevation, atmospheric pressure, and the like.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

The present invention is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be operative, enabling and complete. Like numbers refer to like elements throughout. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described.

Figure 1:
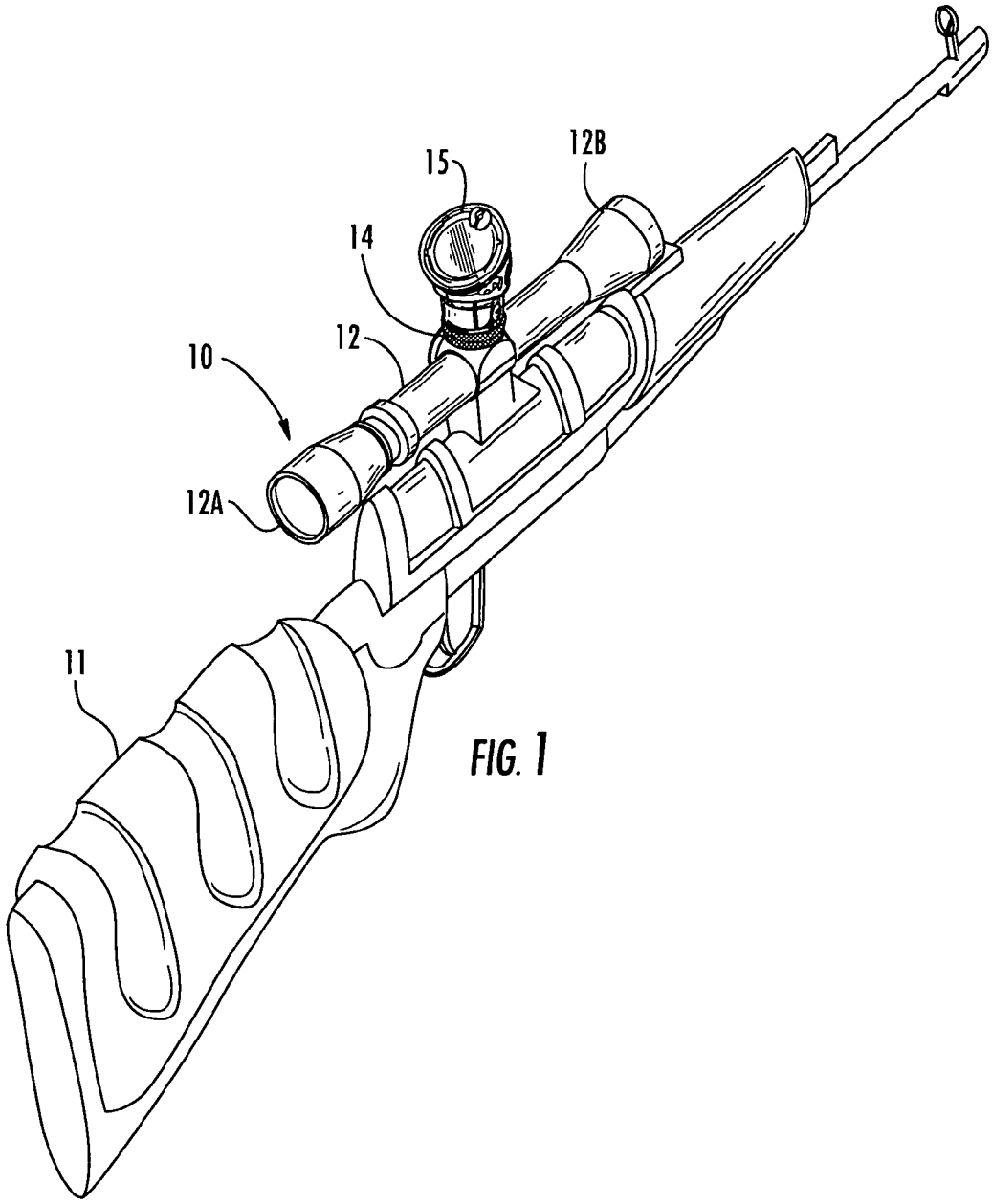
FIG. 1 is a perspective view of a conventional hunting rifle incorporating a scope assembly according to one preferred embodiment of the present invention.

Referring now specifically to the drawings, a scope assembly according to the present invention is illustrated in FIG. 1, and shown generally at reference numeral 10. In the embodiment shown, the scope assembly 10 is used in combination with a conventional hunting rifle 11. The scope assembly 10 attaches directly to the rifle stock using any suitable scope mount commonly known and available in the industry. In other applications, the scope assembly 10 may be used separately (by itself) or in combination with other firearms including shotguns and handguns, blowguns, or bows.

Figure 2:
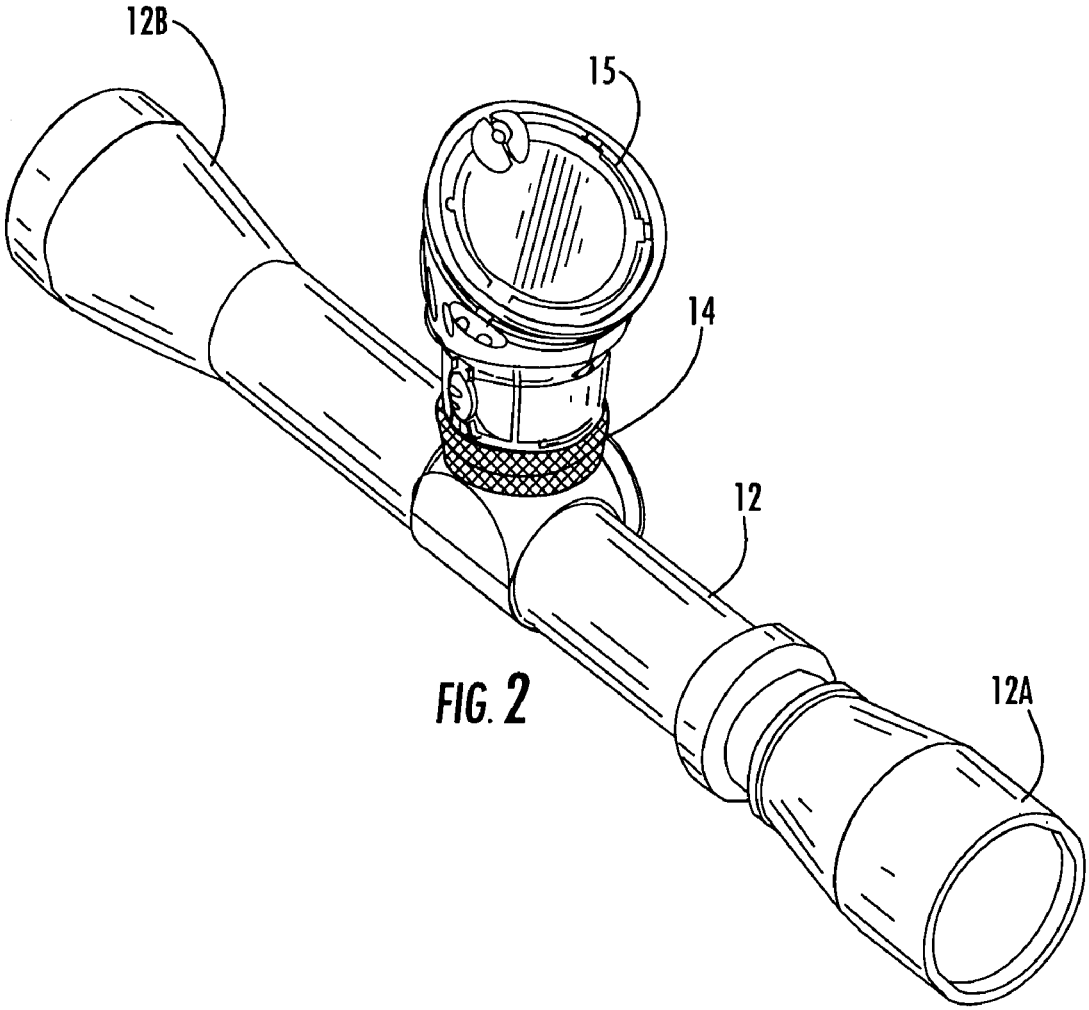
FIG. 2 is an enlarged perspective view of the scope assembly.
Figure 3:
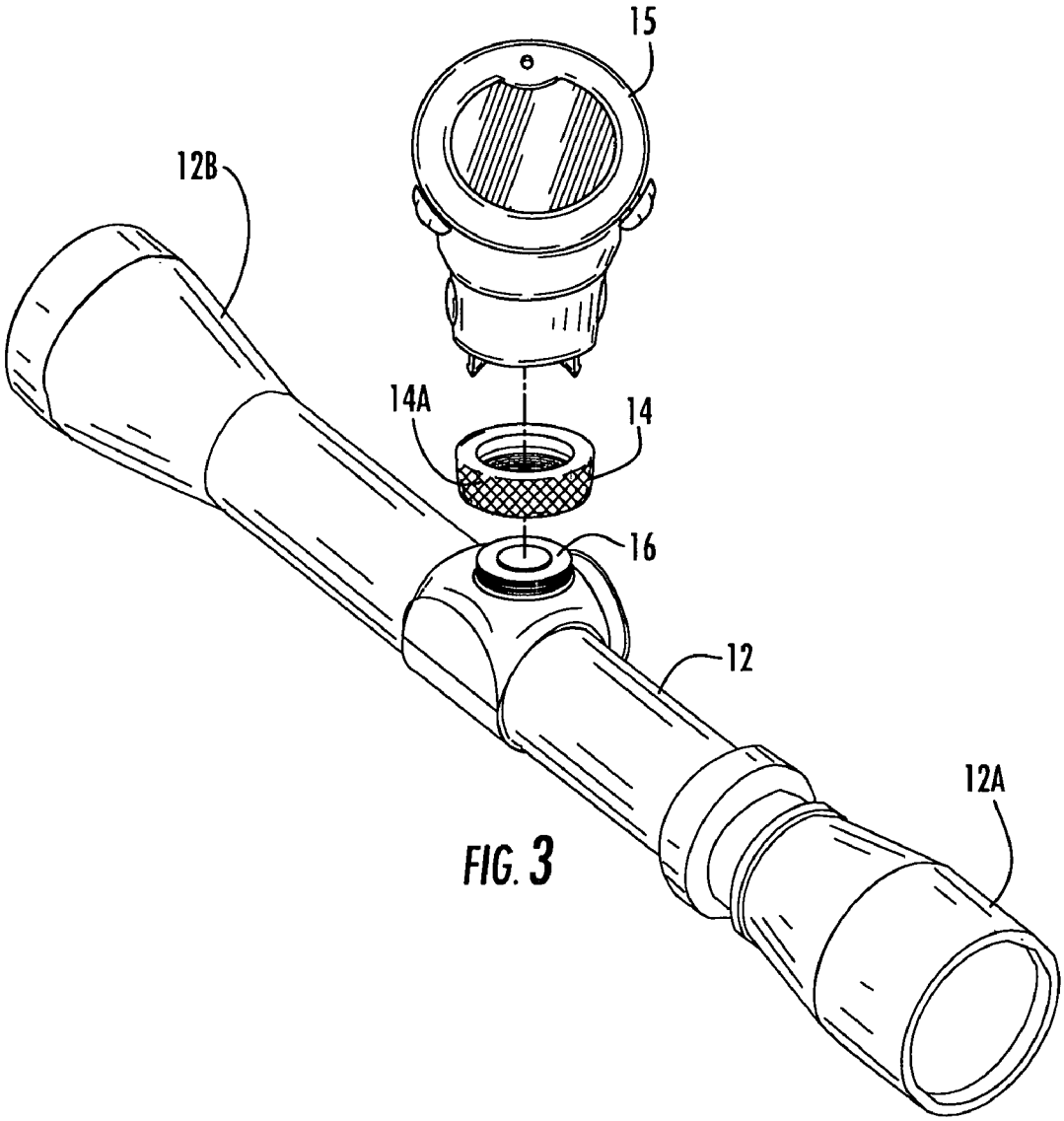
FIG. 3 is an exploded view of the scope assembly showing the scope, scope mount adapter, and instrument accessory disassembled.

As best shown in FIGS. 2 and 3, the scope assembly 10 comprises an elongated vision scope 12, a scope mount adapter 14, and a quick-release instrument accessory 15. The scope 12 has an eyepiece-end 12A and a viewing-end 12B, and is preferably constructed of inner and outer scope tubes. The outer tube is fixed substantially parallel to the rifle barrel. According to one preferred construction, the inner tube is adjustably secured to an inside of the outer tube by a ball-type joint. This joint allows a free end of the inner tube to move in both horizontal and vertical directions relative to the outer tube. Respective sight adjustment mechanisms are located at the top and side of the outer tube and comprise standard control elements, such as jack nuts and screws. The jack screws manipulate the inner tube to align the scope's optical axis (as indicated by crosshairs or comparable reticle) with a point of impact of the projectile at a selected distance. The top mechanism moves the inner tube up and down to adjust the elevation, while the side mechanism moves the inner tube horizontally to adjust for windage. Preferably, at least one of the top and side mechanisms incorporates an exposed (or at least exposable) externally-threaded mounting post 16.

Referring to FIGS. 3-7, the scope mount adapter 14 is generally ring-shaped, and has a textured outside surface 14A to facilitate handling and its application to and removal from the scope 12. According to one embodiment, the scope mount adapter 14 comprises first and second integral connectors 21, 22 separated by a radially-extending annular divider 23. The first connector 21 defines an internal screw thread designed to mate with the complementary external thread of the mounting post 16 to removably attach the adapter 14 to the scope 12. The second connector 22 of the scope mount adapter is designed for releasably attaching the instrument accessory 15 to the scope 12. Preferably, the second connector 22 includes a radially-extending annular edge 24 spaced-apart from the divider 23, and cooperating with the divider 23 to form an annular channel 25. The annular channel 25 is adapted to receive cooperating resilient mounting feet 28 and 29 projecting from a base 30 of the instrument accessory 15. The mounting feet 28, 29 are integrally formed with respective release buttons 31, 32.

Figure 5:
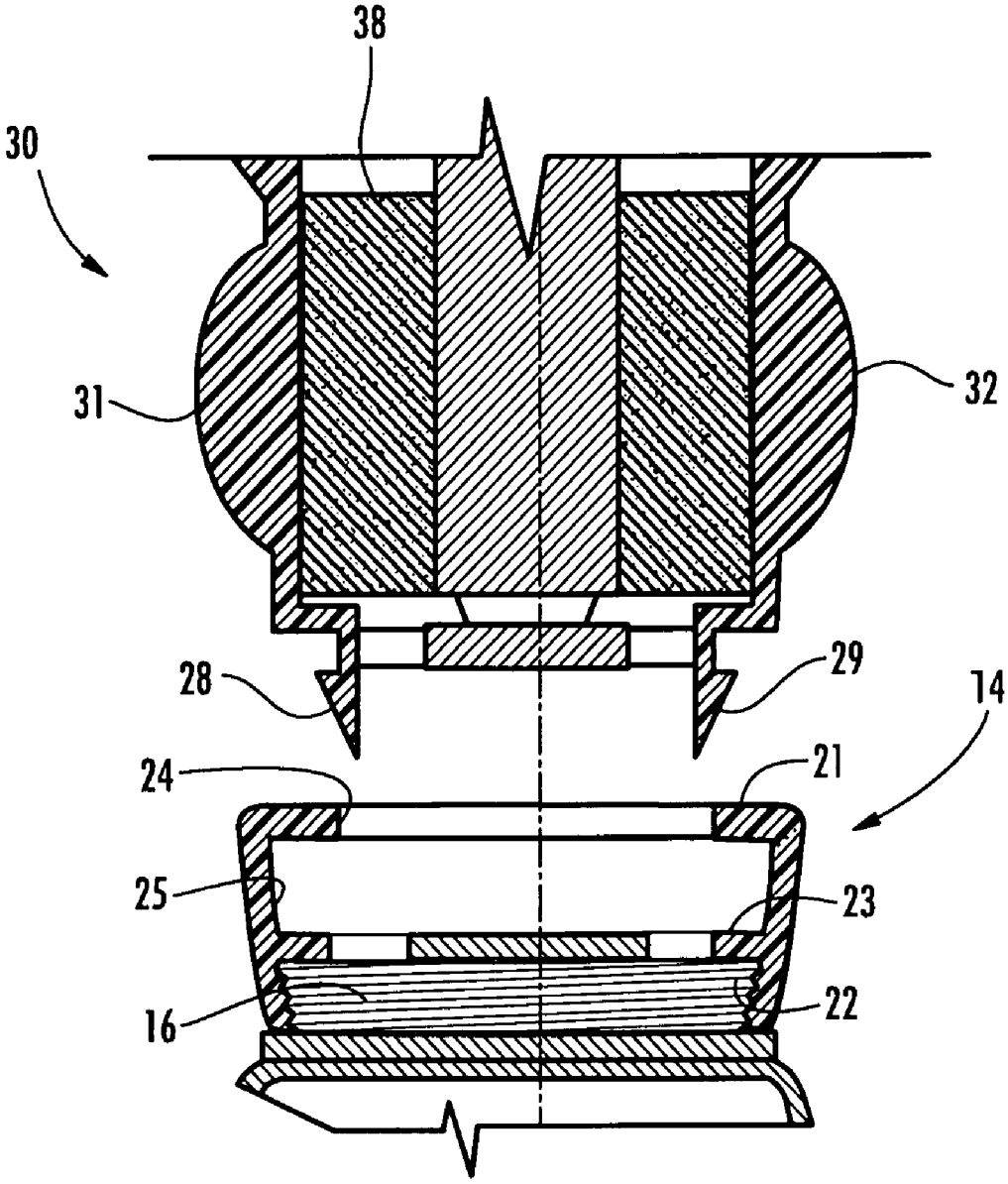
FIGS. 5-7 are fragmentary cross-sectional views demonstrating application of the instrument accessory to the scope mount adapter.
Figure 6:
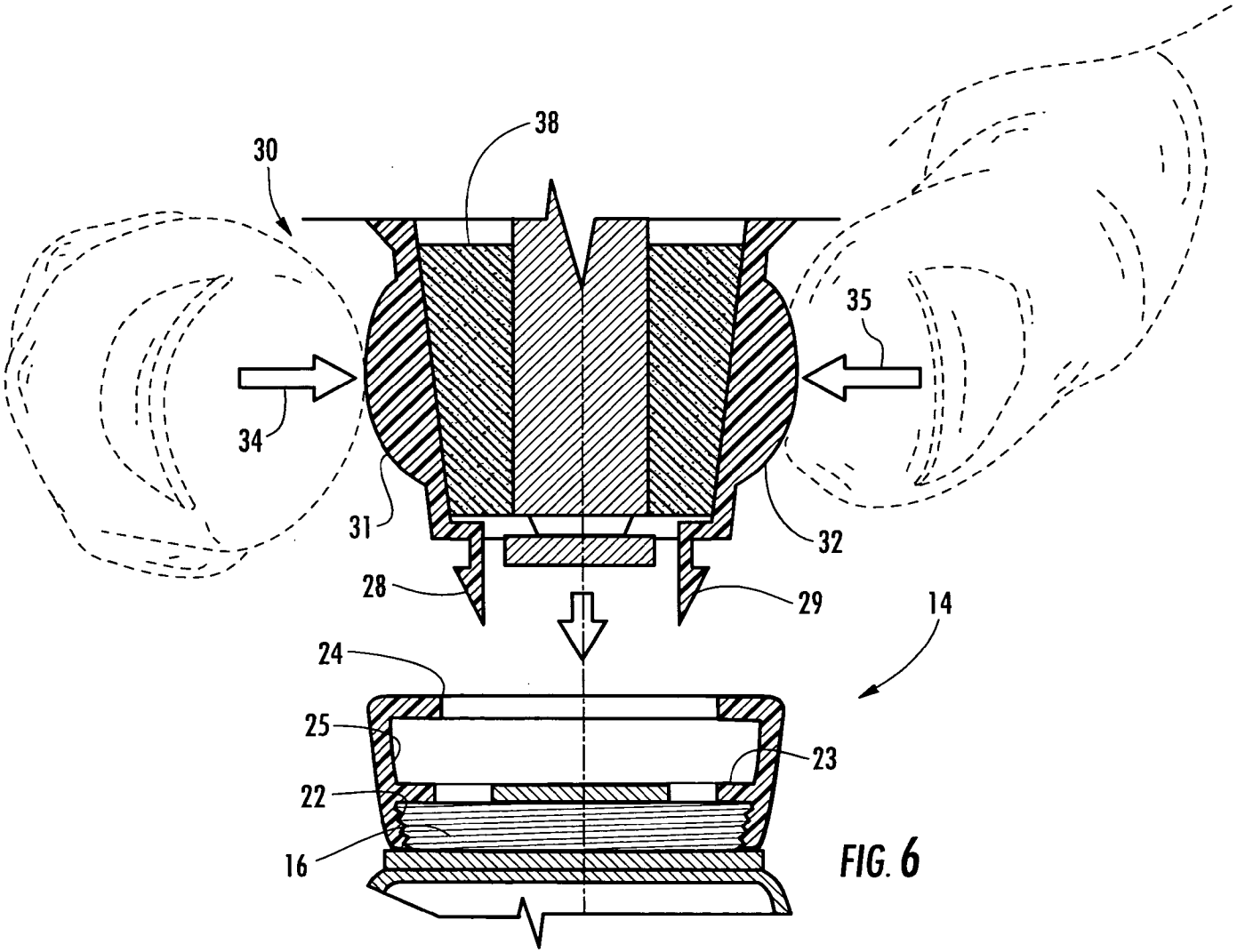
Figure 7:
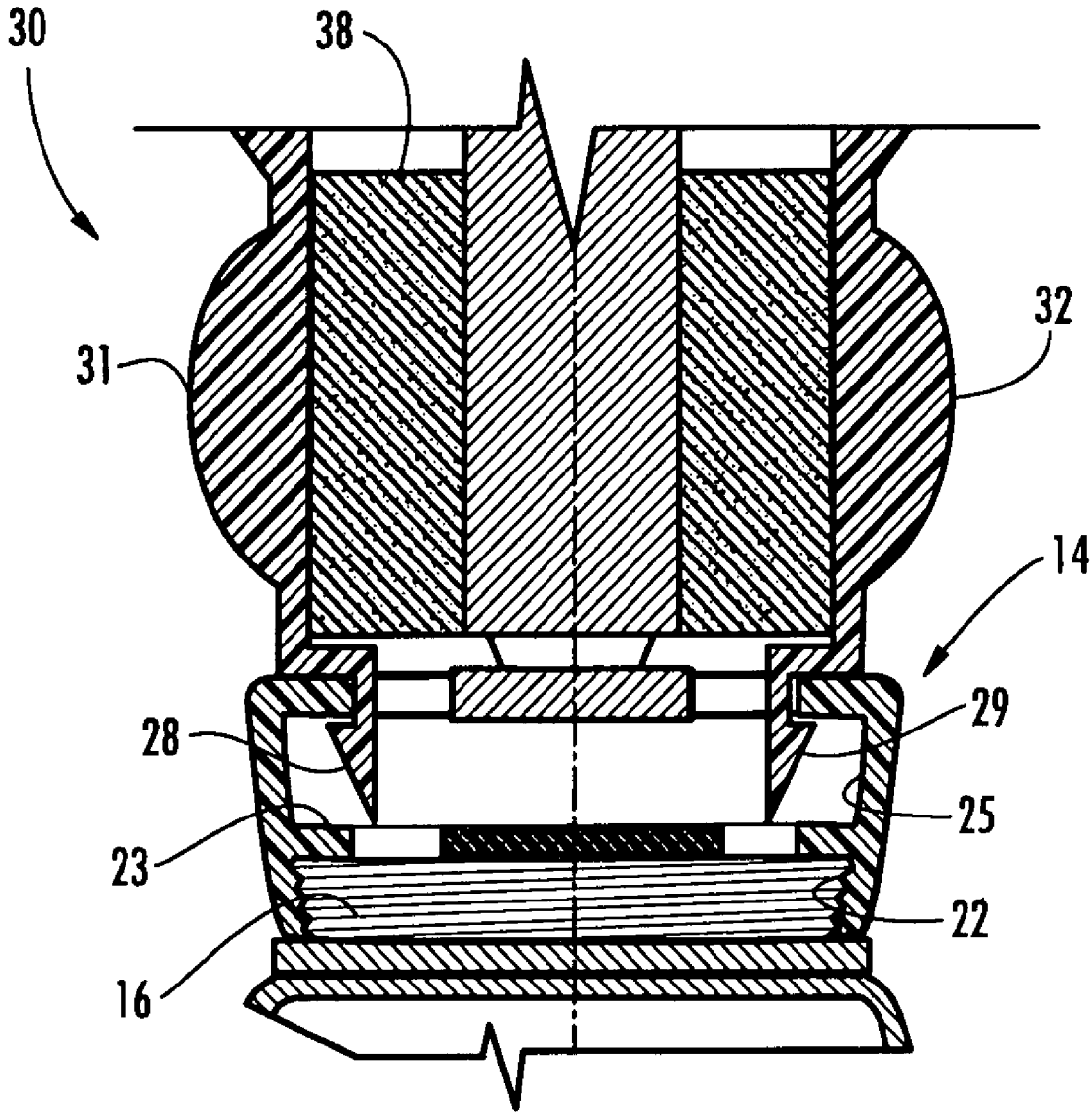

As demonstrated in FIGS. 5-7, the instrument accessory 15 is applied to the scope mount adapter 14 by first pinching the release buttons 31, 32 together in directions indicated by arrows 34 and 35 in FIG. 6. This pushes the mounting feet 28, 29 together, and allows ready insertion of the feet 28, 29 through a top opening defined by the annular edge 24 of the adapter 14. Once inserted and released, the mounting feet 28, 29 return to their original spread condition and occupy a space within the adapter channel 25, as shown in FIG. 7. Preferably, a foam rubber or other resilient material 38 is located inside the base 30 of the instrument accessory 15 adjacent the release buttons 31, 32 to urge and maintain the mounting feet 28, 29 in their spread condition after locating inside the adapter channel 25. The annular edge 24 and mounting feet 28, 29 cooperate to releasably lock the instrument accessory 15 onto the scope mount adapter 14. Preferably, the adapter channel 25 enables 360-degree rotational adjustment of the instrument accessory 15 relative to the scope 12. The instrument accessory 15 is quickly and easily removed from the scope 12 by pinching the release buttons 31, 32, as previously described, and separating the accessory 15 from the scope mount adapter 14.

Figure 4:
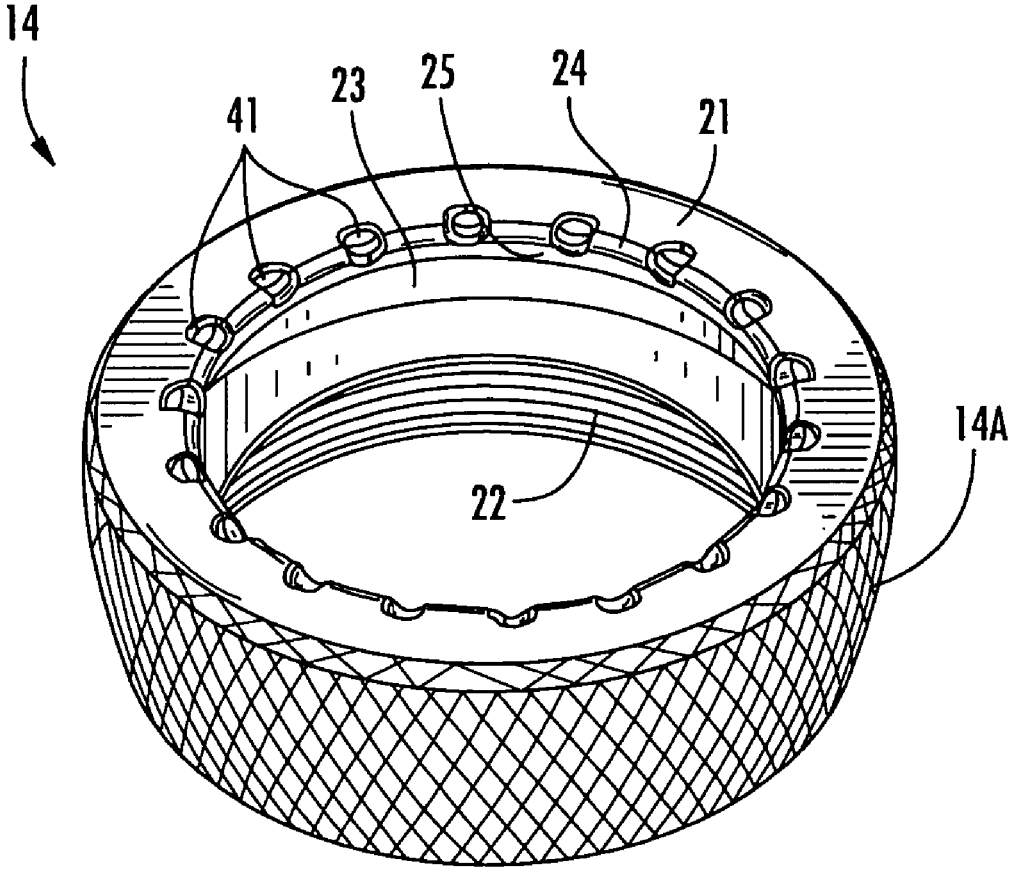
FIG. 4 is an enlarged perspective view of the scope mount adapter.
Figure 8:
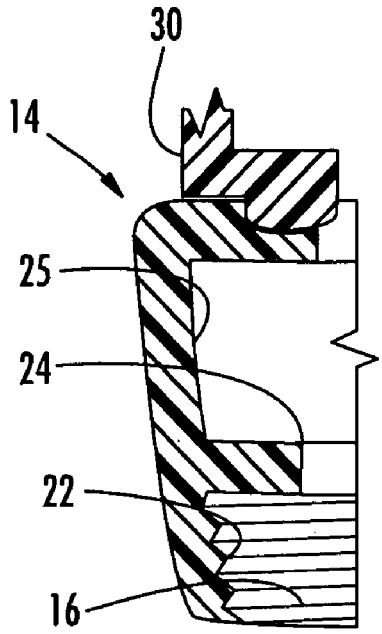
FIG. 8 is a fragmentary cross-sectional view showing the base nub of the instrument accessory mated with the indexing detent of the scope mount adapter.
Figure 9:
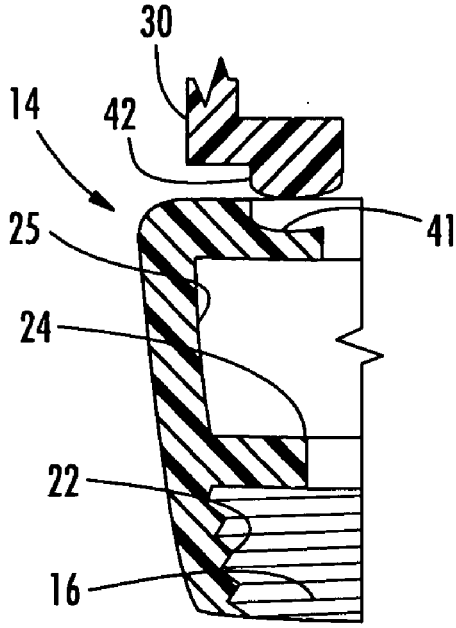
FIG. 9 is a fragmentary cross-sectional view showing the base nub of the instrument accessory removed from the indexing detent of the scope mount adapter.

Referring to FIGS. 4, 8 and 9, the scope mount adapter 14 preferably includes circumferentially-spaced indexing detents 41 formed along the annular edge 24. The detents 41 selectively receive a complementary rounded nub 42 formed with the base 30 of the instrument accessory 15 (see FIGS. 8 and 9), and define respective indexing points for orienting the instrument 15 accessory relative to the scope 12. The mating nub 42 and detent 41 create a sufficient holding force to secure the instrument accessory 15 in the desired set position until further adjusted by the user.

Figure 10:
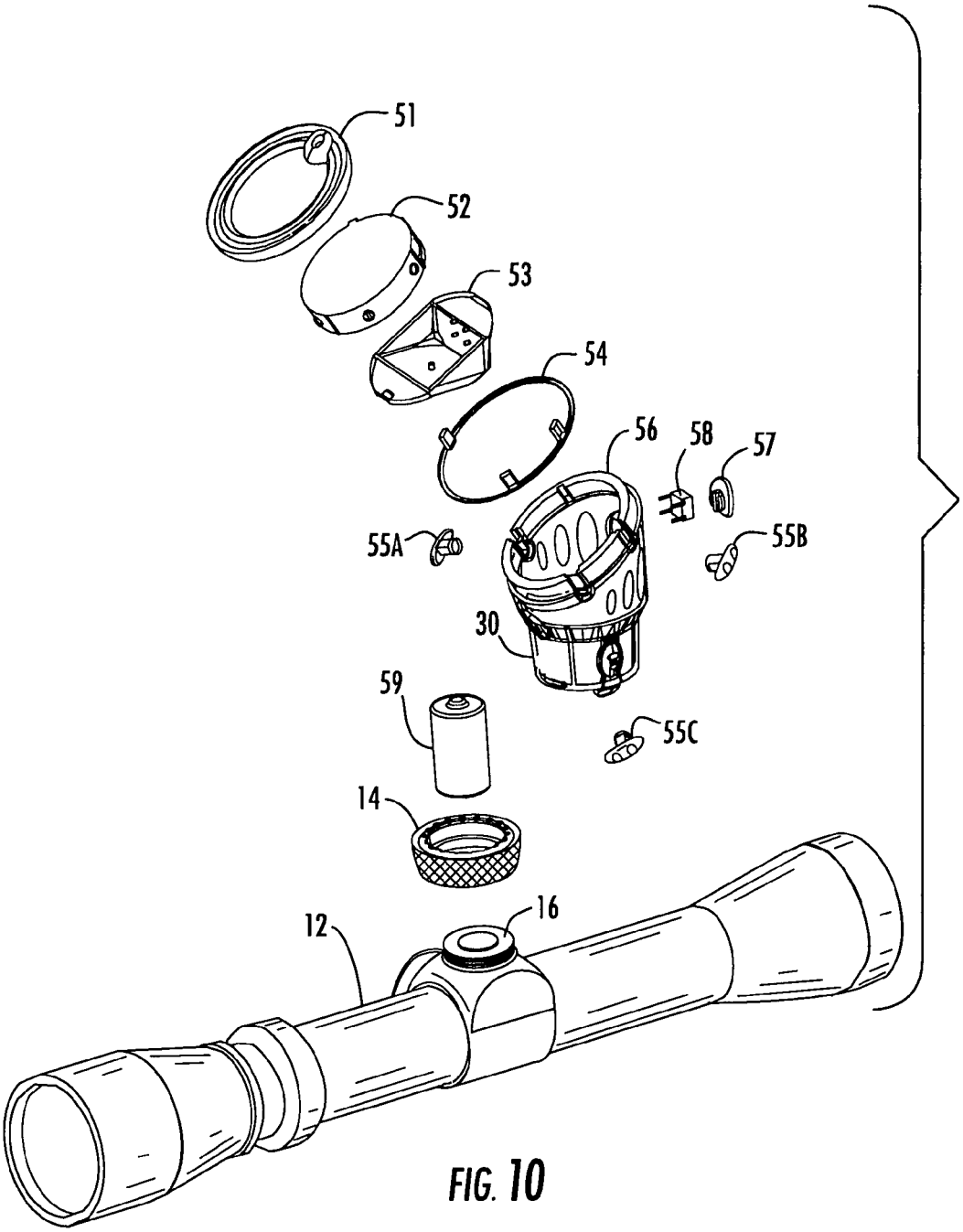
FIG. 10 is a perspective view showing various parts of the instrument accessory exploded away.
Figure 11:
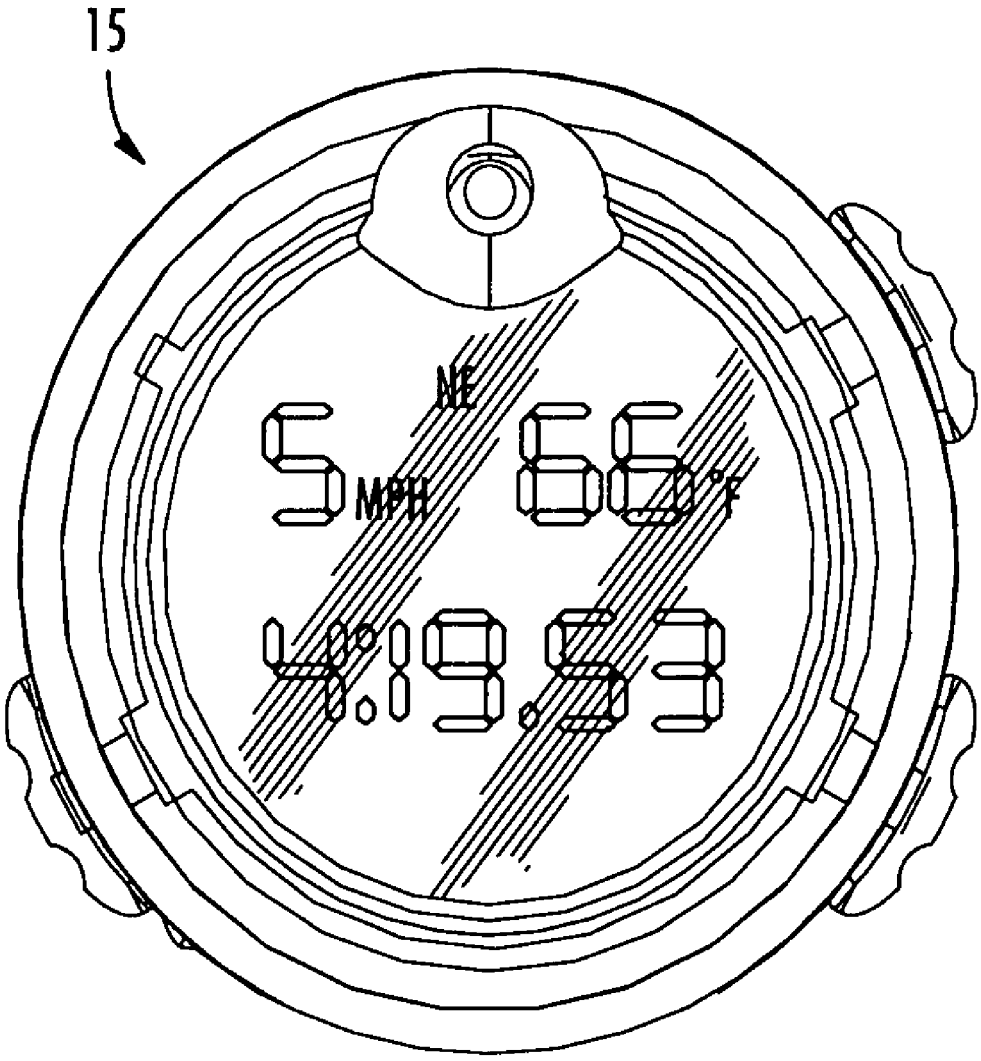
FIG. 11 is top view of the instrument accessory.

FIGS. 1-3, 10 and 11 illustrate one preferred embodiment of the quick-release instrument accessory 15. As shown in FIG. 10, the instrument accessory 15 incorporates an assembly of off-the-shelf parts comprising a lens cap 51, electronics housing 52, internal spacer 53, gasket 54, input buttons 55A-55C, instrument housing 56, LED light button 57, SMT switch 58, and battery 59. The electronics housing 52 preferably incorporates conventional means for calculating and displaying time, temperature, windage, elevation, and atmospheric pressure. In other embodiments, the scope assembly 10 may combine other quick-release accessories including a cell phone, pager, PDA, range finder, 2-way radio, GPS, flashlight, camera, cartridge carrier, or the like. These other accessories may be formed or retro-fitted with a base having quick-release elements, such as those described above, designed for use with the present scope mount adapter 14. Additionally, the scope mount adapter 14 may be formed in a variety of sizes for use on different scopes.

A scope assembly is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A scope assembly, comprising:

an elongated viewing scope having first and second opposite ends, and at least one externally-threaded mounting post located between the opposite ends;

a scope mount adapter comprising first and second connectors, the first connector having an internal screw thread mating with the external thread of said mounting post, and the second connector comprising a radially-extending annular edge; and a scope accessory releasably coupled to said scope mount adapter, and comprising resilient feet located between the first connector and the radially-extending annular edge of the second connector, said feet comprising interfering structure cooperating with said annular edge to lock said accessory onto said scope, and enabling quick release of said accessory from said scope when pinched together.

2. A scope assembly according to claim 1, wherein said scope mount adapter is substantially ring-shaped.

3. A scope assembly according to claim 1, and comprising a radially-extending annular divider located between the first and second connectors of said scope mount adapter.

4. A scope assembly according to claim 3, wherein the radially-extending annular edge of said second connector is spaced-apart from said divider, and cooperates with said divider to form an annular channel adapted for receiving a connecting element of said accessory, whereby said annular channel enables rotational adjustment of said accessory relative to said scope.

5. A scope assembly according to claim 1, wherein said annular edge of said second connector defines circumferentially-spaced indexing points designed for selectively orienting said accessory relative to said scope.

6. A scope assembly according to claim 1, wherein said accessory comprises an instrument for displaying information selected from a group consisting of time, temperature, windage, elevation, and atmospheric pressure.

7. In combination with a rifle, a scope assembly comprising:

an elongated viewing scope having first and second opposite ends, and at least one externally-threaded mounting post located between the opposite ends;

a scope mount adapter comprising first and second connectors, the first connector having an internal screw thread mating with the external thread of said mounting post, and the second connector comprising a radially-extending annular edge; and a scope accessory releasably coupled to said scope mount adapter, and comprising resilient feet located between the first connector and the radially-extending annular edge of the second connector, said feet comprising interfering structure cooperating with said annular edge to lock said accessory onto said scope, and enabling quick release of said accessory from said scope when pinched together.

8. A combination according to claim 7, wherein said annular edge of said second connector defines circumferentially-spaced indexing points designed for selectively orienting said accessory relative to said scope.

9. A combination according to claim 7, wherein said accessory comprises an instrument for displaying information selected from a group consisting of time, temperature, windage, elevation, and atmospheric pressure.

* * * * *